US005516222A

United States Patent [19]

Debruin et al.

[11] Patent Number: 5,516,222

[45] Date of Patent: May 14, 1996

[54] PRINTING DEVICE HAVING LIMITED MOVEMENT PAPER GUIDE

[75] Inventors: Raymond A. Debruin, Memphis; John J. Valdes, Cordova, both of Tenn.

[73] Assignee: Brother International Corporation, Somerset, N.J.

[21] Appl. No.: 368,356

[22] Filed: Jan. 4, 1995

[51] Int. Cl.[6] ..... B41J 13/10

[52] U.S. Cl. ..... 400/645.4; 400/643

[58] Field of Search ..... 400/639, 639.1, 400/639.2, 642, 645, 645.3, 645.4, 647, 643, 625

[56] References Cited

U.S. PATENT DOCUMENTS

| | | | |
|---|---|---|---|
| 4,275,969 | 6/1981 | Matsuhisa et al. | 400/642 |
| 4,437,780 | 3/1984 | Weber et al. | 400/642 |
| 4,729,557 | 3/1988 | Kiyohara | 271/272 |
| 5,170,184 | 12/1992 | Hanabusa et al. | 400/645 |
| 5,244,295 | 9/1993 | Terashima et al. | 400/639 |

FOREIGN PATENT DOCUMENTS

| | | | |
|---|---|---|---|
| 420400 | 4/1991 | European Pat. Off. | 400/642 |
| 031666 | 2/1989 | Japan | 400/642 |
| 032880 | 2/1990 | Japan | 400/642 |
| 209277 | 8/1990 | Japan | 400/642 |
| 107168 | 4/1992 | Japan | 400/645 |

*Primary Examiner*—Ren Yan
*Attorney, Agent, or Firm*—Oliff & Berridge

[57] ABSTRACT

A paper conveyance system for individually transporting cut sheets having various thicknesses and rigidity through a printing device includes a main roller for driving the cut sheets, a nip pair located downstream of the main roller, and a top paper guide movable to accommodate the cut sheets having variable thicknesses. The cut sheets are transported between the top paper guide and the main roller and the system includes a device or limiting mechanism for preventing the top paper guide from rotating greater than a predetermined amount in the event that thick or stiff sheet material is conveyed through the printing device. With such an arrangement, both thin sheet and thick sheet material can be accurately directed to a nip roller pair located at an outlet of the printing device. A holder for an upper one of the roller nip pair also includes a tapered guide portion for guiding the leading edge and the longitudinal edges of the sheet material as the sheet material passes through the nip roller pair.

3 Claims, 8 Drawing Sheets

PRINTING DEVICE HAVING LIMITED MOVEMENT PAPER GUIDE

BACKGROUND OF THE INVENTION

1. Field of the Invention

This invention relates to conveying sheet material through a printing device and, more particularly, a printing device having a pivotably restricted paper guide for accurately guiding cut sheet paper having various thicknesses toward a nip of a nip roller pair.

2. Description of the Related Art

Printing devices such as ink jet printers or thermal printers have a main shaft that includes one or more coaxial drive rollers and a plurality of pinch rollers to define a paper transport path between the pinch rollers and the one or more drive rollers. Cut sheet or continuous paper is generally transported over about half the circumference of the one or more drive rollers so that a printing side of the sheet material is exposed to a printing device such as an ink jet or a thermal printer. One example of such a device can be found in U.S. Pat. No. 4,729,557 to Kiyohara.

In order to maintain an adequate degree of frictional contact between the advancing sheet material and the one or more drive rollers, prior art devices employ resilient guide members or spring members to directly or indirectly press the sheet material into contact with the drive roller with the sheet material sandwiched between the pinch and drive rollers during transport. The spring members must apply a strong enough force to the sheet material such that adequate friction is maintained between the drive roller and the sheet material. The force applied to the sheet material by the spring or the guide member, however, must not be so strong that thin sheet material cannot overcome the force applied by the spring member. Moreover, spring members that apply a force that is too strong will cause a thin sheet material to jam within the printing device.

One solution as set forth in U.S. Pat. No. 4,729,557 is to provide relatively weak spring members that are upon engagement even with relatively thin sheet material. However, in the event of printing a relatively thick (or stiff) sheet material, the relatively weak spring, which is sufficient for guiding a relatively thin sheet material, fails to provide adequate force to the thick material such that proper amount of friction is maintained between the thick material and the drive roller. In addition, relatively thick sheet material includes an inherent rigidity such that as the relatively thick material is guided around the main drive rollers, the relatively thick material has a tendency to bend the relatively weak spring to an undesirable extent. This results in paper jams for thick sheet material because the leading edge of the thick material is not properly guided to an outlet or an acceptable position relative to a nip roller pair located adjacent the outlet of the printing device.

SUMMARY OF THE INVENTION

This invention thus overcomes the above and other deficiencies and disadvantages of the conventional guidance and transporting systems for printers, by providing a limited movement guide mechanism.

According to the first aspect of the present invention, there is provided a paper conveyance system for individually transporting cut sheets having various thicknesses through a printing device. The paper conveyance system includes a main roller for driving the cut sheets, a nip pair located downstream of the main roller, a top paper guide movable to accommodate the cut sheets having various thicknesses, the cut sheets being transported between the top paper guide and the main roller, and a device for directing the cut sheets only to a space between a nip of the nip pair and a lower half of an upper one of the nip pair.

The paper conveyance system may also include a device for limiting upward movement that may include a pin fixably mounted to a frame member. The device for limiting upward movement of the top paper guide may limit movement of the top paper guide within an angle defined by an intersection between a first line tangent to the main roller and intersecting a nip of the nip pair, and a second line tangent to the main roller and intersecting a center of the upper one of the nip pair.

According to a second aspect of the present invention, there is provided a printer including a printhead, a main roller for individually transporting cut sheets, an outlet for the cut sheets, a paper guide adjacent the main roller, and a limiting member for limiting upward movement of the paper guide to thereby direct the cut sheets to the outlet. The transporting and guiding assembly may also include a nip roller pair including a star roller and a star wheel drive roller, the nip roller pair being located adjacent the outlet. In addition, the limiting member may prevent movement of the paper guide above a lower half of the star roller, thereby properly directing the cut sheets to a nip of the nip roller.

According to a third aspect of the present invention, there is provided a typewriter including a printhead and a keyboard operatively communicated with the printhead. The guidance system includes a main drive, a nip pair having an upper roller and a lower roller, and a guide mechanism for guiding the sheet material from the main drive to a space defined by a half of the upper roller closest to the lower roller.

The guidance system may also include a frame pivotably mounting the guide mechanism, the guide mechanism having a first end connected to a spring, the spring also being connected to the frame such that the spring biases a second end of the guide mechanism toward the main drive.

Furthermore, the guidance system of the third aspect of the present invention may include a limiting member including a pin mounted on the frame above the guide mechanism, wherein a clearance may be created between the pin and the guide mechanism such that the guide mechanism is prevented from moving above the lower half of the star wheel.

These and other aspects and advantages of the present invention are described in or apparent from the following detailed description of preferred embodiments.

BRIEF DESCRIPTION OF THE DRAWINGS

A preferred embodiment of the present invention will be described in detail with reference to the accompanying drawings, wherein.

DETAILED DESCRIPTION OF PREFERRED EMBODIMENTS

A preferred embodiment of the invention will be described below with reference to the accompanying drawings.

Figure 1:
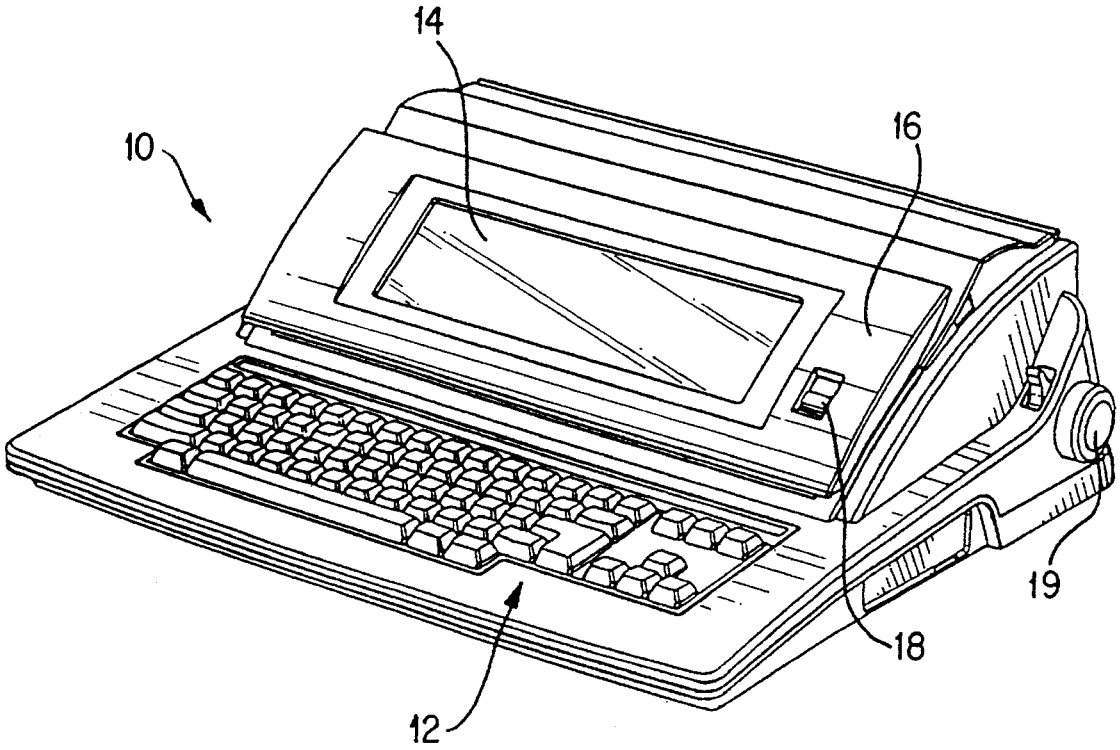
FIG. 1 is an isometric view of a typewriter generally showing the keyboard and the liquid crystal display.

As shown in FIG. 1, an ink jet typewriter 10 of the present invention comprises a keyboard 12 and a liquid crystal display 14 for displaying typed text before it is printed on a recording medium. The liquid crystal display 14 is mounted on a cover 16 that is pivotable to various set positions according to user preference. The pivotal panel 16 includes a control mechanism 18 for varying the light intensity and/or contrast of the liquid crystal display. The typewriter 10 also may include all necessary mechanisms found on conventional machines, such as a manual paper advancement knob 19.

Figure 2:
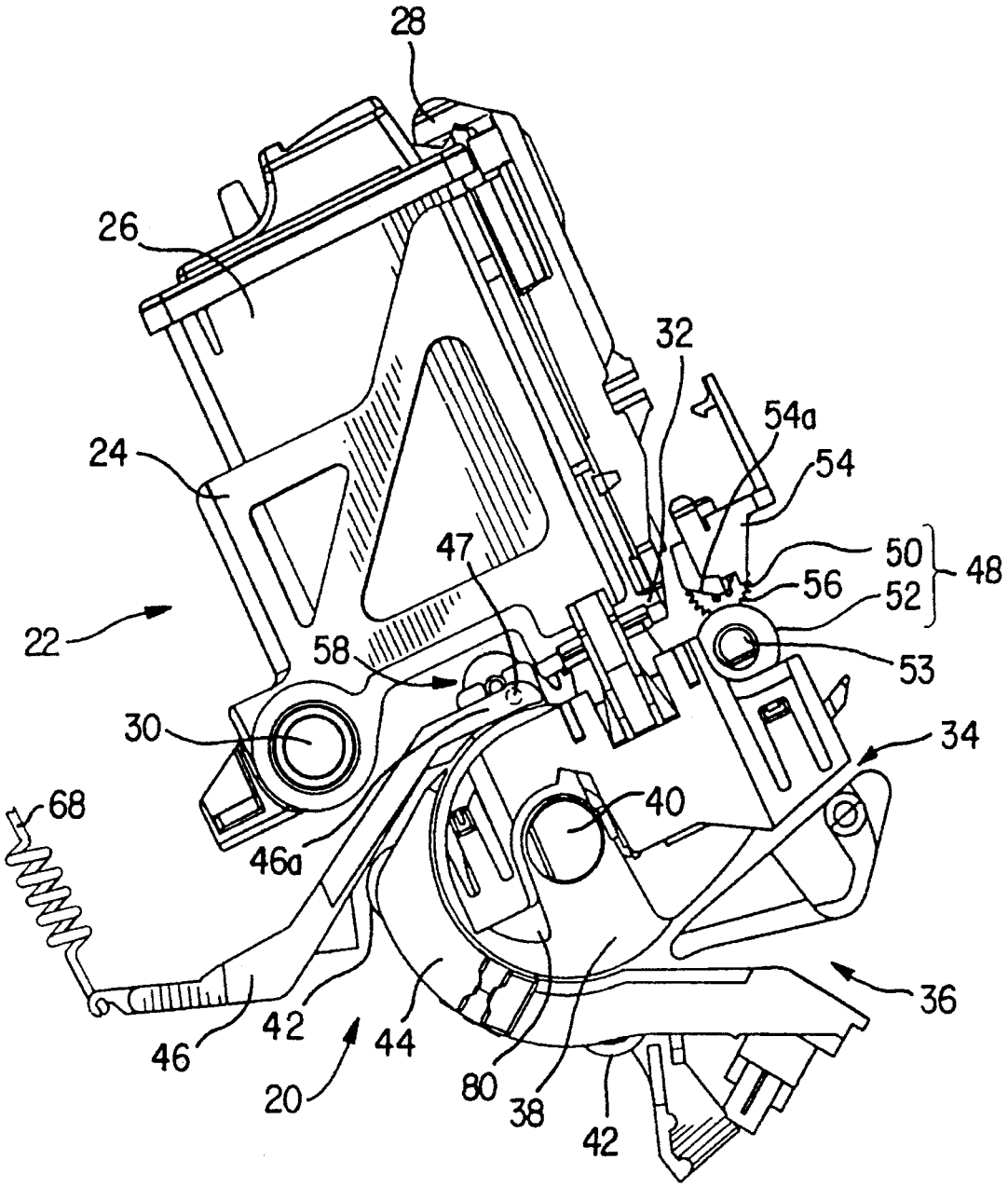
FIG. 2 is a side elevational view showing the paper conveying mechanism and ink jet carriage assembly.
Figure 3:
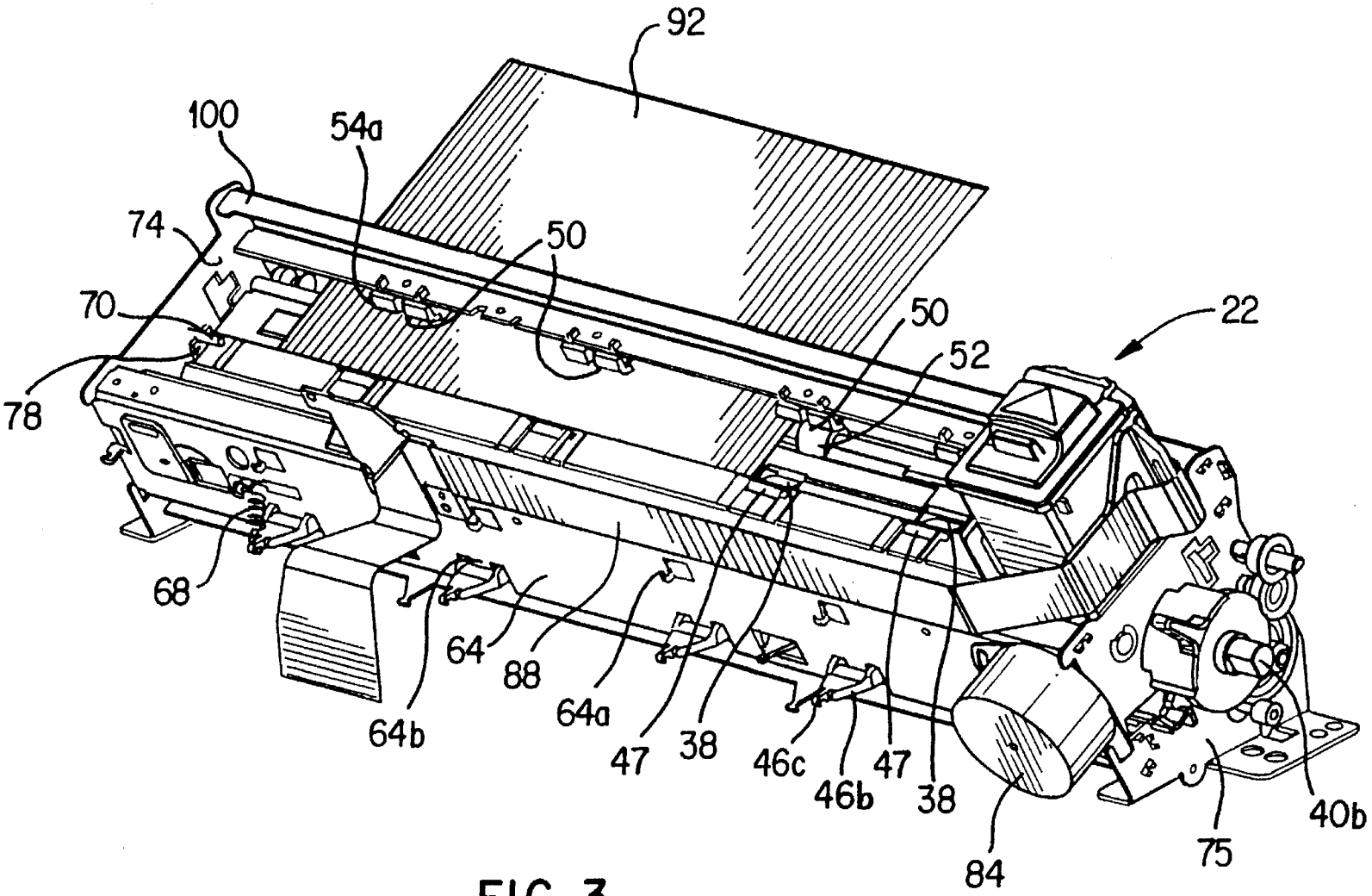
FIG. 3 is an isometric view of the present invention showing a flexible cable communications link and a sheet material within the printing device.

FIGS. 2 and 3 show details of the paper guidance and conveying mechanism 20 in relation to the reciprocable printing mechanism 22. The reciprocable printing mechanism 22 includes a carriage 24 and a cartridge 26 that is fitted onto the carriage 24 using a flexible tab mechanism 28. The carriage 24 and the cartridge 26, as an integral unit, are reciprocated along main shaft 30. As the printing unit 22 is reciprocated along the shaft 30, a print head 32, such as an ink jet print head having ink jet nozzles, prints characters on to a recording medium 92, such as cut sheet paper documents or other sheet material, which may have various thicknesses. The print head 32 is formed as an integral part of the cartridge 26.

The paper conveyance and guidance mechanism 20 includes a first paper sheet path 34 for relatively thin documents and a second paper sheet path 36 used primarily for relatively thick documents that are thicker than the relatively thin documents. The first and second cut sheet paper paths 34 and 36 converge where the cut sheet documents engage a main drive, for example, main paper feed rollers 38 (only one of which is shown in FIG. 2), which are mounted on and driven by a main roller shaft 40. The cut sheet material travels along a paper transport path along a circumference of the driven main rollers 38 and is initially pressed against the main rollers 38 by pinch rollers 42. Two pinch rollers, for example, are rotatably mounted on a lower paper guide 44 for each main roller 38. The second paper path 36 is positioned lower than the first paper path 34 because thick paper includes an inherent rigidity. By providing the second paper path 36 at a position where thick sheet paper will be required to conform to a lesser circumferential extent of the main roller 38 than the relatively thin paper entering from the first paper path 34, relatively thick paper entering in second path 36 will not exceed a critical bending radius and therefore will not be permanently curled or deformed upon exiting the printing device.

After the cut sheet material is initially transported between the lower paper guide 44 and the main rollers 38 along the paper transport path, the cut sheet paper engages a top paper guide 46, which rotatably mounts a series of additional pinch rollers 47, before being guided to a position accessible to the ink jet 32 and eventually toward nip roller pairs 48 that each include a relatively hard star wheel 50 that slightly protrudes into a relatively soft star wheel drive roller 52. The star wheel 50 and the star wheel drive roller 52, for example, are made of respectively, metal and rubber. The star wheel 50 is rotatably mounted on a star wheel holder 54 such that the star wheel drive rollers 52, which are mounted on and driven by a star drive roller shaft 53, engage and drive the star wheels 50 to transport cut sheet documents through the outlet of the printer.

FIG. 3 shows the overall architecture of printing device and shows a typical example of how a sheet material is conveyed through the printing device. In FIG. 3, the sheet material 92 is transported between main drive rollers 38 and corresponding pinch rollers 47, which are rotatably mounted on the top paper guide 46. The leading end of the sheet material is then directed to the roller nip pairs 48, each of which include a star wheel 50 and a star wheel drive roller 52. FIG. 3 also shows a flexible flat cable 88 that provides communication between a circuit board (not shown) and the circuitry of ink jet print head 32 to provide printing signals to the nozzles.

The top paper guide 46 is mounted to guide incoming cut sheet paper from the main rollers 38 and toward the nip roller pairs 48. In the case of a thin sheet material entering through paper path 34, the top paper guide 46 only very slightly moves away from the main rollers 38 a distance that is approximately equal to the thickness of the thin sheet material. In this event, the thin sheet material is accurately directed to the nip 56 between the star wheels 50 and the star wheel drive rollers 52.

A thick sheet material, such as cut sheet paper having the rigidity of a postcard, entering the paper transport path from the second sheet path 36 travels along the paper sheet path between the lower paper guide 44 and the main rollers 38, with the pinch rollers 42 maintaining adequate force on the thick sheet material so as to supply an adequate amount of frictional driving force between the main rollers 38 and the relatively thick sheet material. Once the thick sheet material makes contact with a first end **46*a* of the top paper guide 46, the inherent stiffness of the thick sheet material has a tendency to bias the pivotably mounted top paper guide 46 away from the main rollers 38. The stiffness of the thick sheet material is strong enough to bias the pinch rollers 47 of the top paper guide 46 away from the main rollers 38 such that the clearance between the lower surface of the top paper guide 46 or the lower surface of pinch rollers 47 and the main rollers 38 is greater than the thickness of thick sheet material. This results from the fact that relatively weak springs 68 are used to bias the top paper guide 46 into engagement with the main rollers 38, the relatively weak springs 68 having a strength such that relatively thin sheet material can force the top paper guide 46 away from the main rollers 38 against the force of the relatively weak springs 68**.

Accordingly, a limiting member 58 is provided above a top surface of a top end **46*a* of the top paper guide 46. When the inherent rigidity of a thick or stiff sheet material attempts to force the top paper guide 46 away from the main rollers 38, the top end 46*a* abuts the limiting member 58 to prevent the top paper guide 46 from moving or pivoting more than a predetermined angular amount away from the main rollers 38**.

Figure 4:
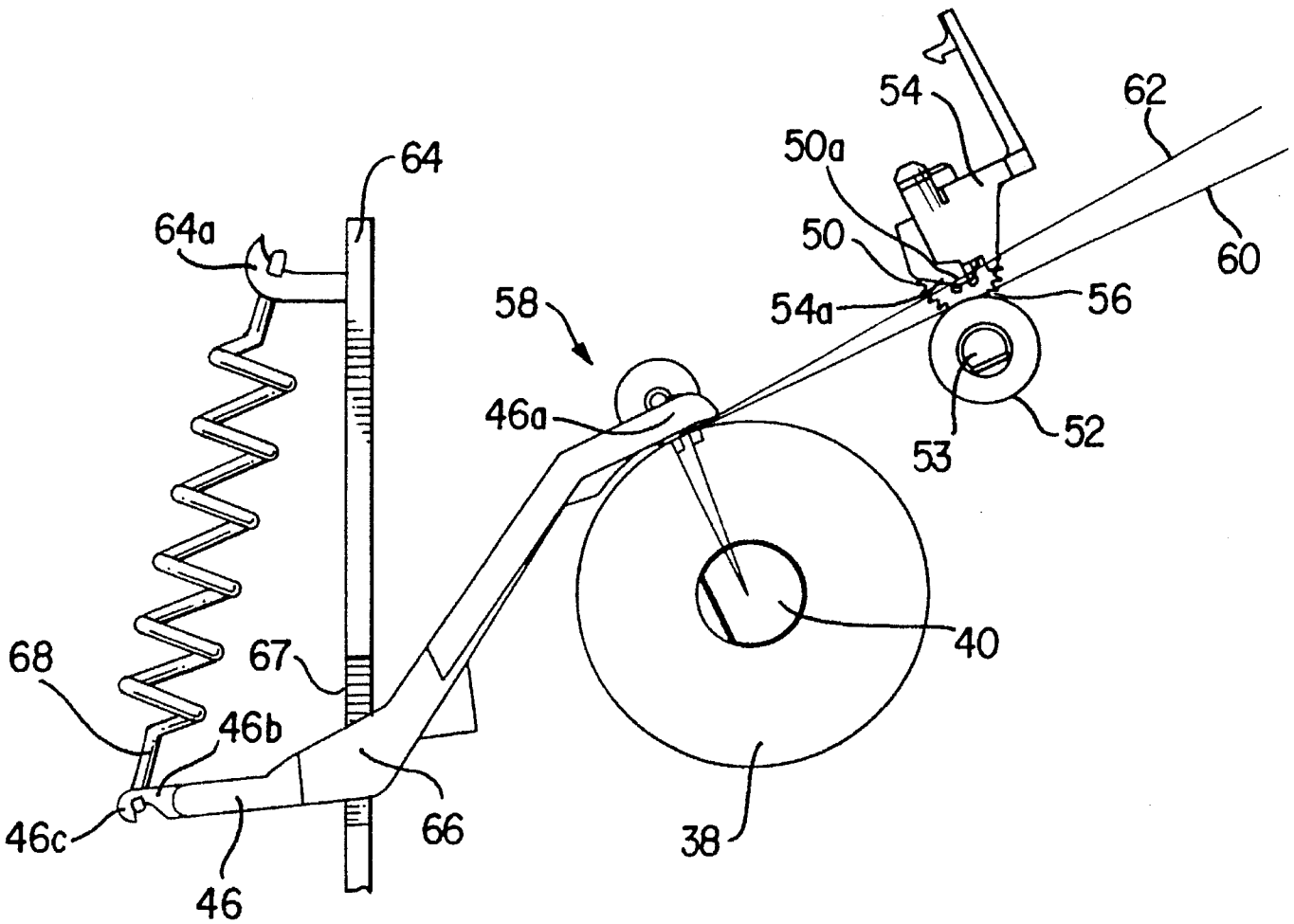
FIG. 4 is a generally schematic diagram showing details of the limited angular movement of the top paper guide.

As shown in FIG. 4, the angular amount is determined by an intersection between a first line 60 and a second line 62.

The first line 60 is tangent to the main roller 38 and intersects the nip 56 between the star wheel 50 and the star wheel drive roller 52. The second line 62 is also tangent to the main roller 38 and intersects a center 50*a* of the star wheel 50. Accordingly, the limiting member 58 is positioned to allow limited angular movement of the guide mechanism 46, that the sheet material generally follows a path projecting from the pinch roller 47, the path being generally parallel to a bottom surface of the top end 46*a* of the top guide portion 46. The path of the sheet material is maintained between the center 50*a* of the star wheel 50 and the nip 56 between the star wheel 50 and the star wheel drive roller 52. Additionally, a tapered guide portion 54*a* is provided on the star wheel holder 54 to further ensure proper guidance of the leading and longitudinal edges of the sheet material. (This aspect of the invention will be more particularly described below with reference to FIGS. 8 and 9.)

Also as shown in FIG. 4, the top paper guide 46 is pivotably mounted about an axis 66 provided in an opening 67 on a wall member 64, which is only partially illustrated in FIG. 4. A second end 46*b* of the top paper guide 46 includes a hook portion 46*c* that engages a biasing mechanism such as a spring member 68. A second end of the biasing mechanism is connected to a hook member 64*a* that may be integrally formed in the wall portion 64 by cutting out a predetermined shape and then bending the hook portion 64*a* away from the wall member 64 at an angle of approximately 90°. Of course, other members of the printing device could be provided with a hook portion that serve the same purpose of hook portion 64*a*. Of importance is that spring member 68 provides the guide mechanism 46 with enough pivotable biasing force to maintain thin sheet documents in contact with the surface of main roller 38, while the spring force of the spring 68 at the same time allows relatively thin material to bias the first end 46*a* of the guide mechanism 46 upwardly, thus avoiding paper jams of relatively thin material.

Figure 5:
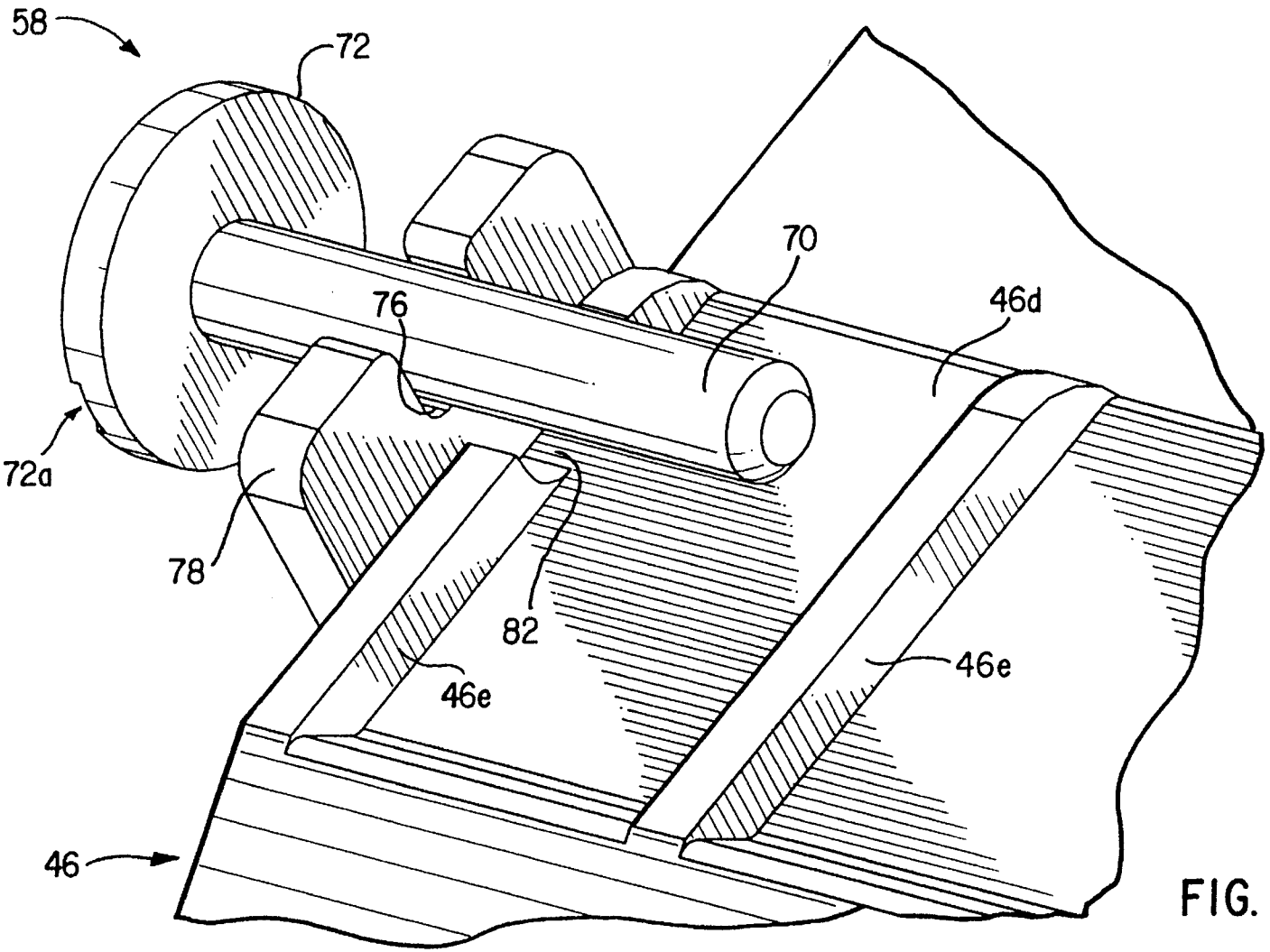
FIG. 5 shows an enlarged isometric view showing details of the engagement between the limiting member and the top paper guide.
Figure 6:
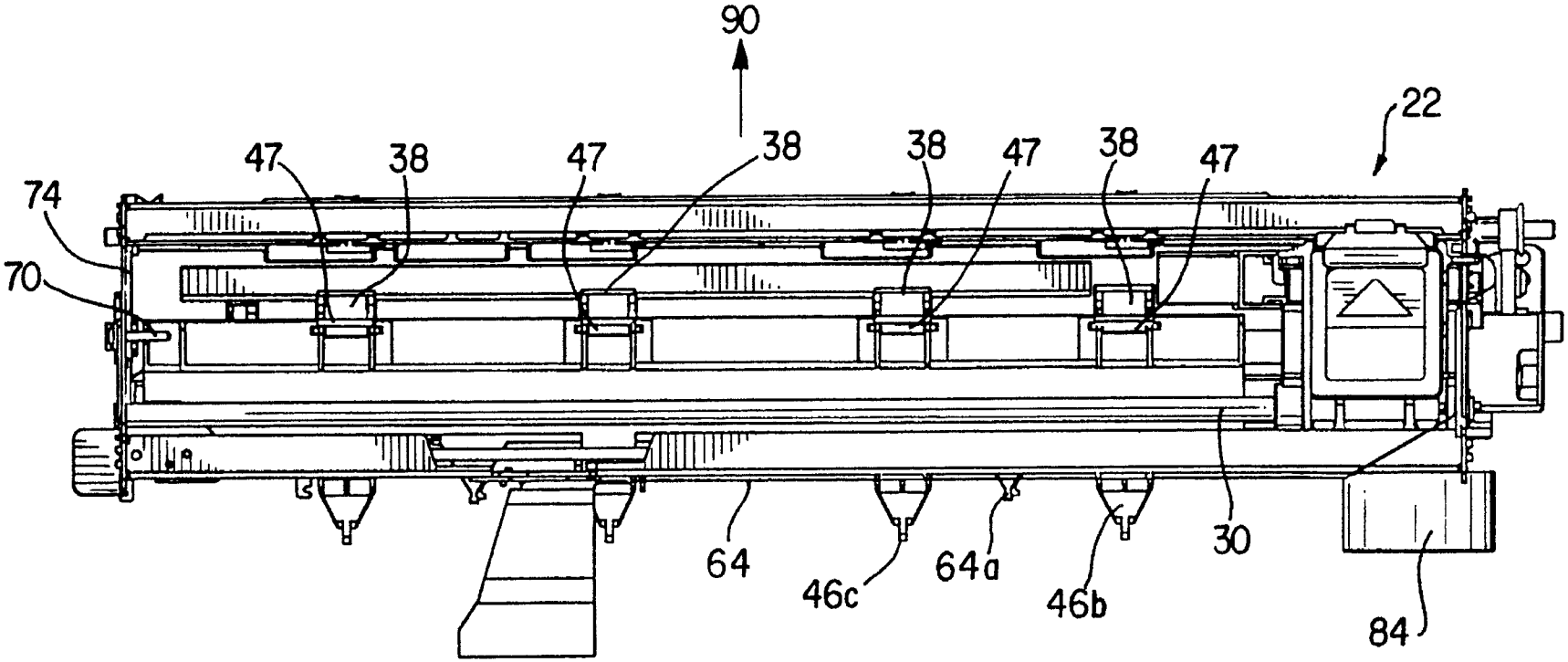
FIG. 6 is a top plan view according to the present invention.
Figure 7:
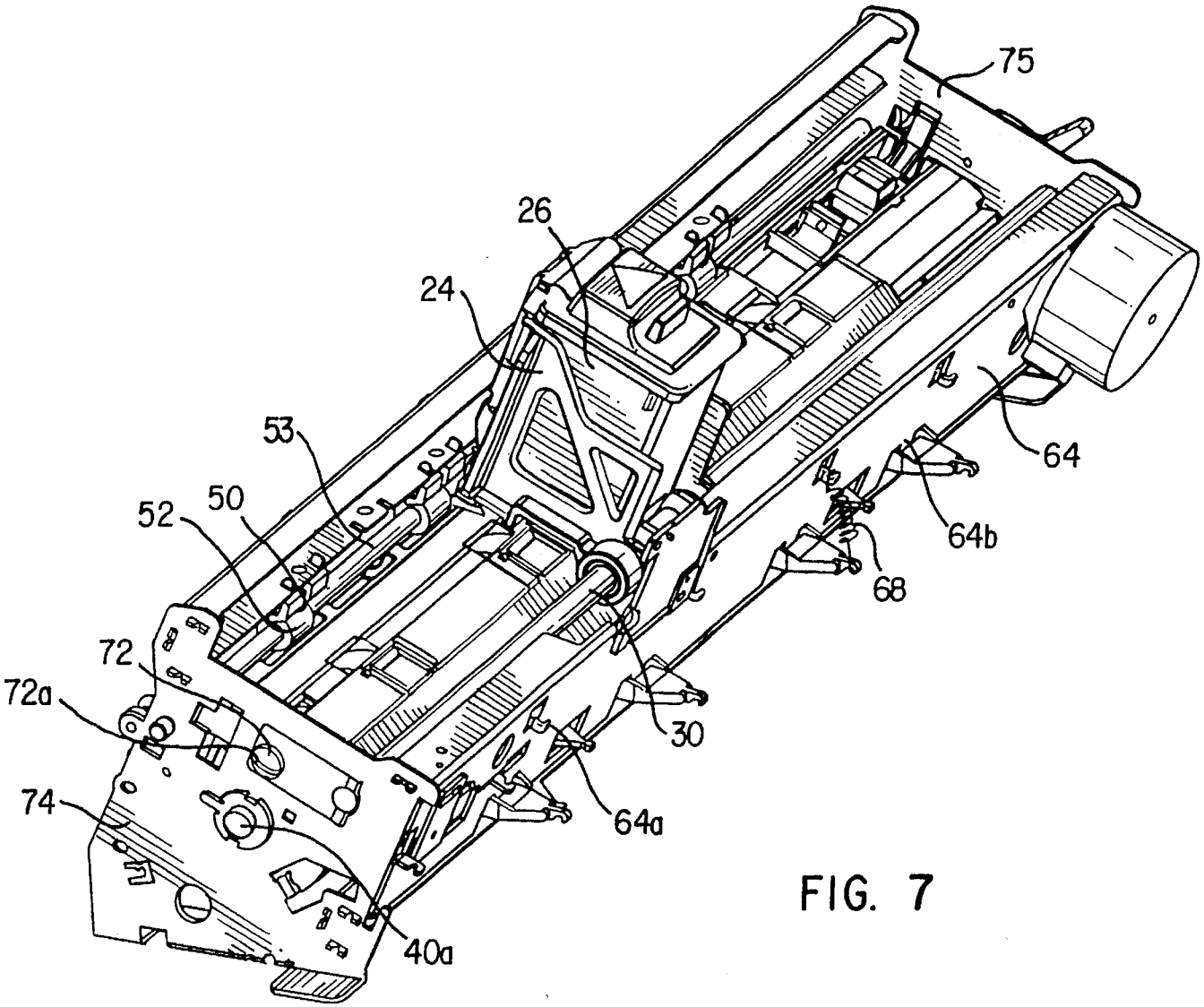
FIG. 7 is an isometric view of the present invention showing the mounting of the limiting member on a frame member.

FIG. 5 shows an enlarged view of the limiting mechanism 58. The limiting mechanism 58 includes a pin 70 that includes a base 72 having a larger diameter than the pin 70. The pin may be a screw member, such as a self-tapping screw, and the base member may include a screw like head having a groove 72*a* for receiving a screwdriver or the like. In any event, the pin 70 is mounted directly on a wall 74 of a chassis or frame, which is not shown in FIG. 5 for clarity, but is shown in FIGS. 3, 6 and 7. The pin member is insertable within a slot 76 of a flange 78. The slot is formed to have a clearance to allow for thermal expansion of the pin 70. The flange 78 is formed as part of a main paper support 80 which is supported by wall 74. The pin 70 further projects within the confines of wall 74 and through flange 78 to come into position just above a top surface 46*d* of the top paper guide 46. The top surface 46*d* of the paper guide 46 is also provided with ribs 46*e* that provide further strength to the top support guide 46. A cut out portion 82 within the rib 46*e* below pin 70 provides a clearance between the top paper guide 46 and the pin 70.

The main paper support 80 assists in guiding sheet material from the main rollers 38 to the nip roller pairs 48. The main support 80 is mounted on the chassis or frame while the main shaft 40 extends through the chassis to be driven by a drive source (not shown). FIG. 7 shows one end 40*a* of main shaft 40 supported in wall 74 while FIG. 3 shows the other end 40*b* of main shaft 40 extending through opposite frame wall 75.

FIGS. 6 and 7 show the overall architecture of the printing device and paper guidance and conveyance assembly, in addition to other features. For example, FIG. 6 is a top plan view showing a carriage motor 84 which reciprocates the integral printing mechanism 22, which includes the carriage 24 and the cartridge 26, using a conventional belt mechanism (not shown), along main shaft 30. FIG. 7 shows the carriage 24 and cartridge 26 in an intermediate position along shaft 30 and more particularly shows the opposite isometric view of the base portion 72 of the pin 70. The slot 72*a* is also shown in FIG. 7. FIG. 7 also shows a pivot member 64*b* that pivotally mounts the guide 46 about pivot axis 66 (FIG. 4).

In general, this arrangement ensures that cut sheet material, regardless of whether the cut sheet material is relatively thin or relatively thick, is properly guided to the outlet 90 of the printing mechanism where the nip roller pairs 48 are located. As long as the cut sheet documents are guided and directed to a lower half of the star wheel 50 closest to the star wheel drive roller 52, the leading edge of the cut sheet documents, whether relatively thick or relatively small, can be effectively grasped by the nip roller pairs 48 and transported therethrough.

Figure 8:
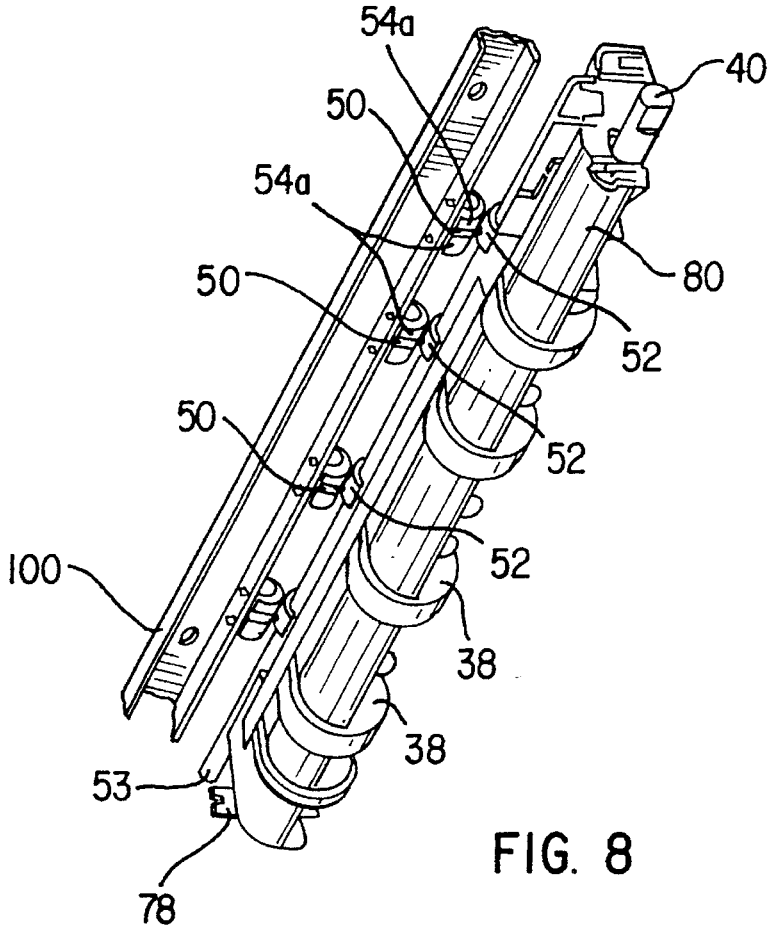
FIG. 8 is a schematic view showing guidance of a leading edge of a sheet material through a plurality of roller nip pairs.
Figure 9:
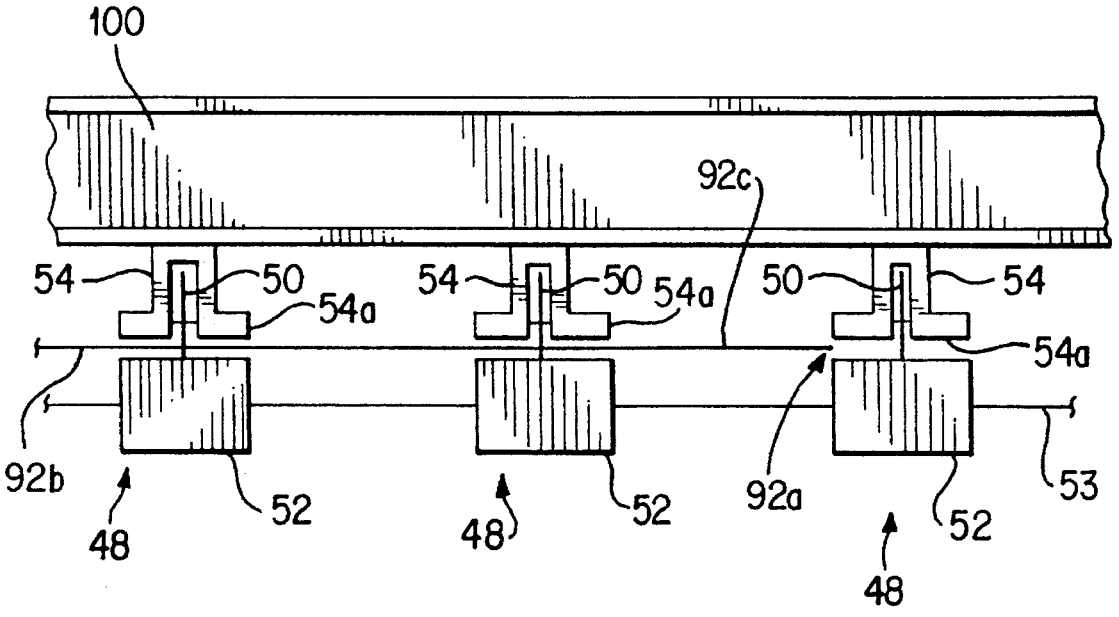
FIG. 9 is a schematic diagram showing a sheet material in relation to the roller nip pairs.

In order to further ensure proper feeding of the leading edge of sheet material though the typewriter, a tapered guide 54*a* is provided on each star wheel holder 54, which is mounted on a bracket 100, as shown in FIGS. 8 and 9. The tapered guide 54*a* assists in the guiding of the longitudinal edges or corners of a sheet material being transported along the sheet conveyance path. In FIG. 9, which generally corresponds to the placement of the sheet material 92 shown in FIG. 3, a plurality of roller nip pairs 48 are shown with the middle part 92*c* of the sheet material 92 being grasped between a centrally located star wheel 50 and star wheel drive roller 52. The edges 92*a* and 92*b*, however, may not exactly correspond to the nip 56 of the nip roller pair nearest the edge to which the nip roller pair 48 is associated. For example, the right edge 92*a* may not engage its closest nip roller pair 48 while the left edge 92*b* may extend slightly beyond the associated nip roller pair 48. Accordingly, the tapered guide 54*a* guides the leading edge so that the longitudinal edges 92 of the sheet material are transported correctly. With this arrangement, the edges 92*a* and 92*b* of the sheet material are substantially prevented from curling toward the center of the sheet material and the edges 92*a* and 92*b* generally remain in the same plane as the center of the paper, thereby improving feeding accuracy and reducing the possibility of paper jams.

While, in the above described embodiment, the paper guidance and conveyance mechanism has been described in conjunction for use with a typewriter printing device, the guidance and conveyance mechanism is not limited to use with such typewriting machines. For example, the conveyance device could be used for paper conveyance and guidance mechanisms for facsimile machines, thermal printers, and the like.

While a preferred embodiment has been described, such description is for illustrative purposes only, and it will be understood that various changes may be made therein to embody the invention without departing from the spirit of the invention as set forth in the following claims.

What is claimed is:

1. A paper conveyance system for individually transporting cut sheets having various thicknesses through a printing device, said paper conveyance system comprising:

a main roller for driving said cut sheets;

a nip pair located downstream of said main roller;

a top paper guide movable to accommodate said cut sheets having said various thicknesses, said cut sheets being transported between said top paper guide and said main roller;

biasing means coupled to said top paper guide for biasing said top paper guide toward said main roller; and means for directing the cut sheets to a limited space defined between a nip of said nip pair, wherein said means for directing the cut sheets is separate from said biasing means and includes means for limiting upward movement of said top paper guide that includes a pin fixedly mounted to a frame member of said paper conveyance system, an upper surface of said top paper guide abutting said pin to limit movement of said top paper guide.

2. A typewriter comprising:

a print head;

a keyboard operatively communicated with said print head;

a main drive for feeding a sheet to said print head;

a nip pair having an upper roller and a lower roller;

a guide mechanism for guiding said sheet material from said main drive to said nip pair within a space defined by a lower half of said upper roller;

an urging mechanism connected to said guide mechanism that urges said guide mechanism toward said main drive; and a limiting member adjacent said guide mechanism for preventing a reference line projecting from said guide mechanism toward said nip pair from moving above said lower half of said upper roller, wherein said limiting member includes a pin mounted on a frame above said guide mechanism with a clearance between said pin and said guide mechanism being such that said guide mechanism is prevented from moving above said half.

3. A typewriter comprising:

a print head;

a keyboard operatively communicated with said print head;

a main drive for feeding a sheet to said print head;

a nip pair having an upper roller and a lower roller;

a guide mechanism for guiding said sheet material from said main drive to said nip pair within a space defined by a lower half of said upper roller;

an urging mechanism connected to said guide mechanism that urges said guide mechanism toward said main drive;

a limiting member adjacent said guide mechanism for preventing a reference line projecting from said guide mechanism toward said nip pair from moving above said lower half of said upper roller, wherein said limiting member includes a pin mounted on a frame above said guide mechanism with a clearance between said pin and said guide mechanism being such that said guide mechanism is prevented from moving above said half; and a main paper support including a flange having a slot, wherein said pin is insertable within said slot.

* * * * *